US005951236A

United States Patent [19]

Thompson

[11] Patent Number: 5,951,236

[45] Date of Patent: Sep. 14, 1999

[54] DEVICE FOR ATTACHING TO A VEHICLE TO FORM A FORK LIFT

[76] Inventor: Michael J. Thompson, P.O. Box 1002, Lakeside, Ariz. 85929

[21] Appl. No.: 09/020,918

[22] Filed: Feb. 9, 1998

[51] Int. Cl.[6] ..... B66F 9/06

[52] U.S. Cl. ..... 414/607; 414/667; 414/785

[58] Field of Search ..... 414/24.5, 462, 414/540, 607, 631, 663, 664, 667, 785

[56] References Cited

U.S. PATENT DOCUMENTS

| | | | |
|---|---|---|---|
| 2,653,678 | 9/1953 | Lehrman | 414/639 X |
| 3,086,618 | 4/1963 | Christiansen | 414/607 X |
| 3,175,721 | 3/1965 | Smith | 414/639 |
| 3,795,331 | 3/1974 | Guest | 214/145 |
| 3,876,039 | 4/1975 | Bushnell, Jr. | 414/785 X |
| 4,024,973 | 5/1977 | Siderits et al. | 414/785 X |
| 4,177,001 | 12/1979 | Blackwood | 414/628 |
| 4,279,604 | 7/1981 | Kooi et al. | 414/667 |
| 4,325,666 | 4/1982 | Chain et al. | 414/540 X |
| 4,545,721 | 10/1985 | Pettersson | 414/724 |
| 4,599,038 | 7/1986 | Wolf | 414/785 |
| 4,640,662 | 2/1987 | Spellman, Jr. | 414/642 |
| 4,708,576 | 11/1987 | Conley | 414/607 |
| 4,987,976 | 1/1991 | Daugherty | 414/785 X |
| 5,190,437 | 3/1993 | Perry | 414/722 |
| 5,590,998 | 1/1997 | Wilcox | 414/607 |

FOREIGN PATENT DOCUMENTS

| | | | |
|---|---|---|---|
| 3007901 | 9/1981 | Germany | 414/607 |

*Primary Examiner*—James W. Keenan
*Attorney, Agent, or Firm*—David L. Volk

[57] ABSTRACT

A winch and rail assembly support structure is adapted to mount to a front of a vehicle. A winch is supported by the winch and rail assembly support structure. A rail assembly is configured to removably connect to the winch and rail assembly support structure. The rail assembly comprises two opposing elongated rails, each elongated rail comprising two opposing tracks, and a pulley supported at a distal end of the rails. A fork assembly comprises an elongated fork support arm configured to span between the rails, a pair of forks configured to connect to the fork support arm, and a plurality of roller wheels connected to the elongated fork support arm. A first pair of the roller wheels is configured to ride within the two opposing tracks of a first one of the rails, and a second pair of the roller wheels is configured to ride within the two opposing tracks of a second one of the rails. A flexible elongated member is configured to extend from the winch, over the pulley, and from the pulley to the fork support arm. The fork support arm is configured to connect to the flexible elongated member. When the winch is operated in a first direction, the flexible elongated member pulls the fork assembly upward along the rails, and when the winch is operated in a second direction, the fork assembly is lowered along the rails.

14 Claims, 4 Drawing Sheets

DEVICE FOR ATTACHING TO A VEHICLE TO FORM A FORK LIFT

BACKGROUND OF THE INVENTION

1. Field of the Invention

The present invention relates to fork lifts, particularly to devices which attach to vehicles to form a fork lift.

2. Description of the Related Art

Small business owners, handymen, contractors, farmers and others often need equipment for lifting heavy objects. Fork lifts designed for this purpose are expensive. Devices which attach to vehicles to form a fork lift provide the benefits of a fork lift without all of the expense. Such devices of the prior art are generally complicated in structure and limited in usefulness.

What is needed is a device for attaching to a vehicle to form a fork lift which is versatile and simple in construction.

SUMMARY OF THE INVENTION

The device of the present invention for attaching to a vehicle to form a fork lift includes a winch and rail assembly support structure adapted to mount to a front of a vehicle in a vertically adjustable manner. A winch is supported by the winch and rail assembly support structure.

A rail assembly is configured to removably connect to the winch and rail assembly support structure. The rail assembly comprises two opposing elongated rails, each elongated rail comprising two opposing tracks, and a pulley supported at a distal end of the rails. Each of the rails comprises a plurality of segments which are connectable end to end to vary the length of the rails. The rail assembly is supported from grade by a pair of wheels which are vertically adjustable in relation to the rail assembly.

A fork assembly comprises an elongated fork support arm configured to span between the rails, a pair of forks configured to connect to the fork support arm, and four roller wheels connected to the elongated fork support arm. A first pair of the roller wheels is configured to ride within the two opposing tracks of a first one of the rails, and a second pair of the roller wheels is configured to ride within the two opposing tracks of a second one of the rails. The distance between the forks on the support arm is adjustable.

A flexible elongated member is configured to extend from the winch, over the pulley, and from the pulley to the fork support arm. The fork support arm is configured to connect to the flexible elongated member. When the winch is operated in a first direction, the flexible elongated member pulls the fork assembly upward along the rails, and when the winch is operated in a second direction, the fork assembly is lowered along the rails.

The winch and rail assembly support structure includes structure for attachment to other apparatus such as snow plows. Such other apparatus may be attached to the winch and rail assembly support structure in lieu of the rail assembly, when a fork lift is not required.

Because the winch and rail assembly support structure is vertically adjustable on the vehicle, it may be used with vehicles having frames of various heights.

Because the distance between the forks on the support arm is adjustable, the fork assembly may be used for lifting articles of various widths.

Because the rail assembly is removably connectable to the winch and rail assembly support structure, the winch and rail assembly support structure may be left on the vehicle, and the rail assembly removed from the winch and rail assembly support structure, when a fork lift is not needed.

Because the winch and rail assembly support structure includes structure for attachment to other apparatus such as snow plows, the versatility of the present invention is enhanced.

Still further features and advantages will become apparent from the ensuing description and drawings.

DETAILED DESCRIPTION

Figure 1:
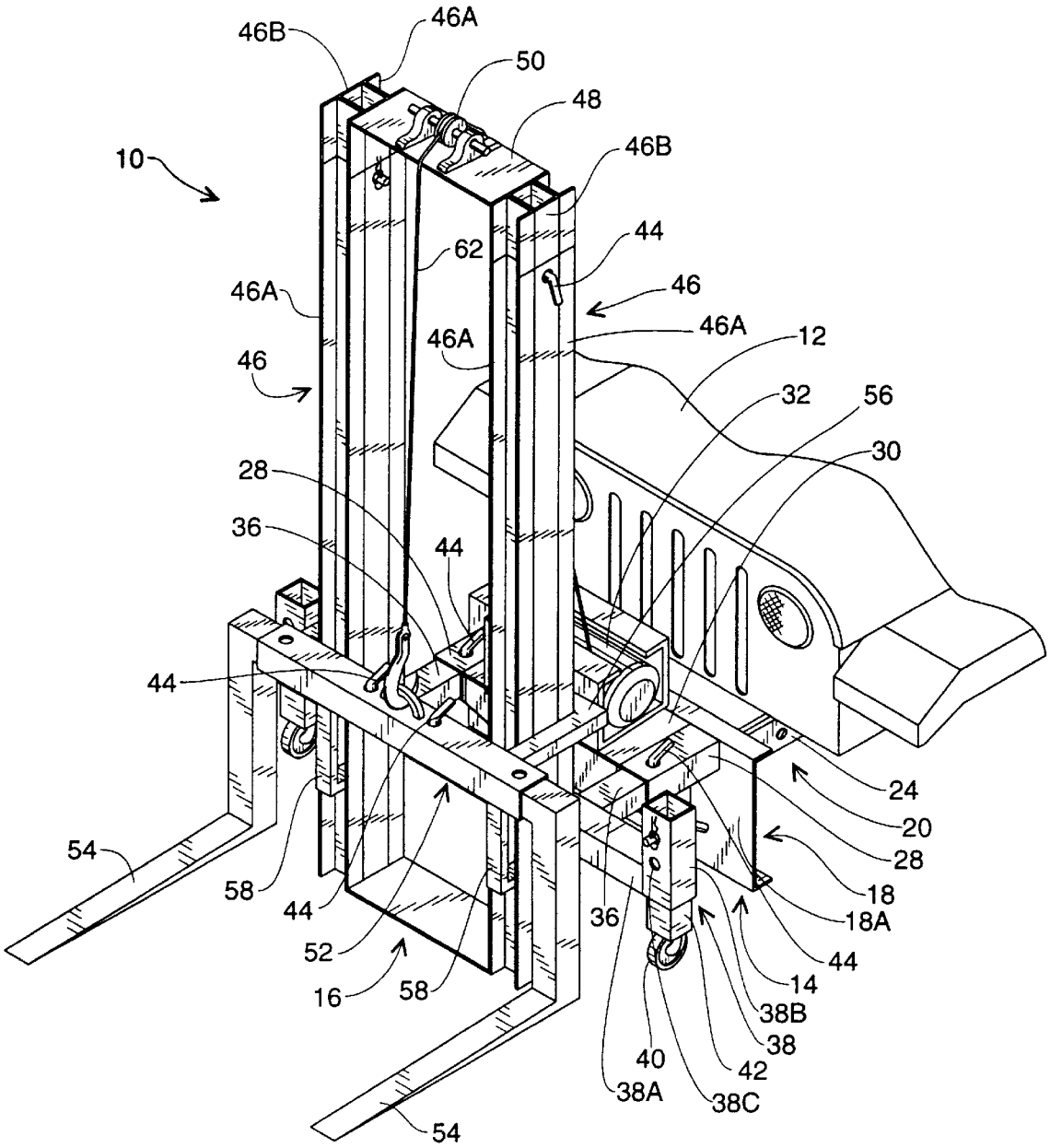
FIG. 1 is a perspective view of the device of the present invention connected to a vehicle.
Figure 2:
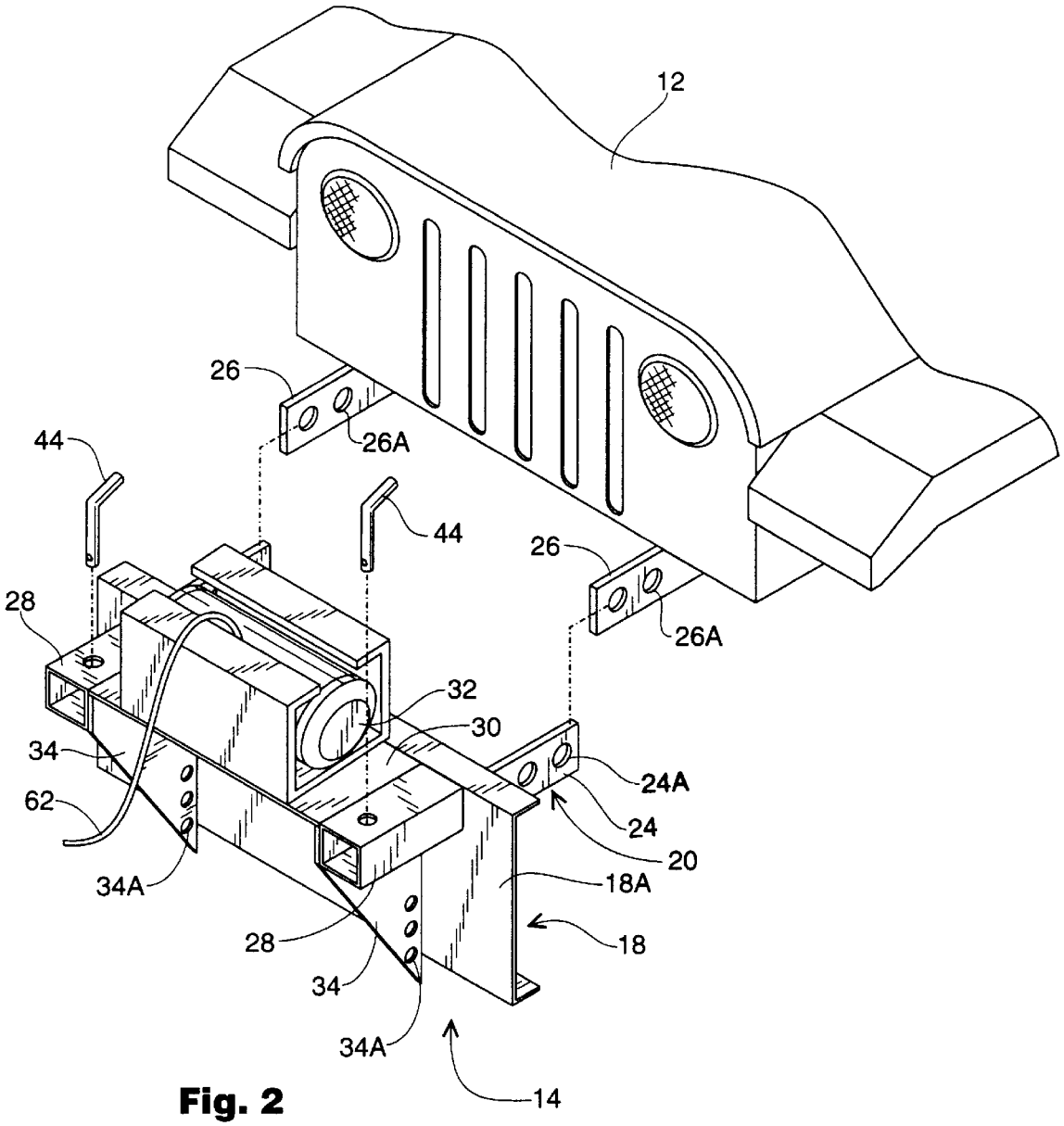
FIG. 2 is an exploded perspective view of the winch and rail assembly support structure and the vehicle, shown apart from the rail assembly.
Figure 3:
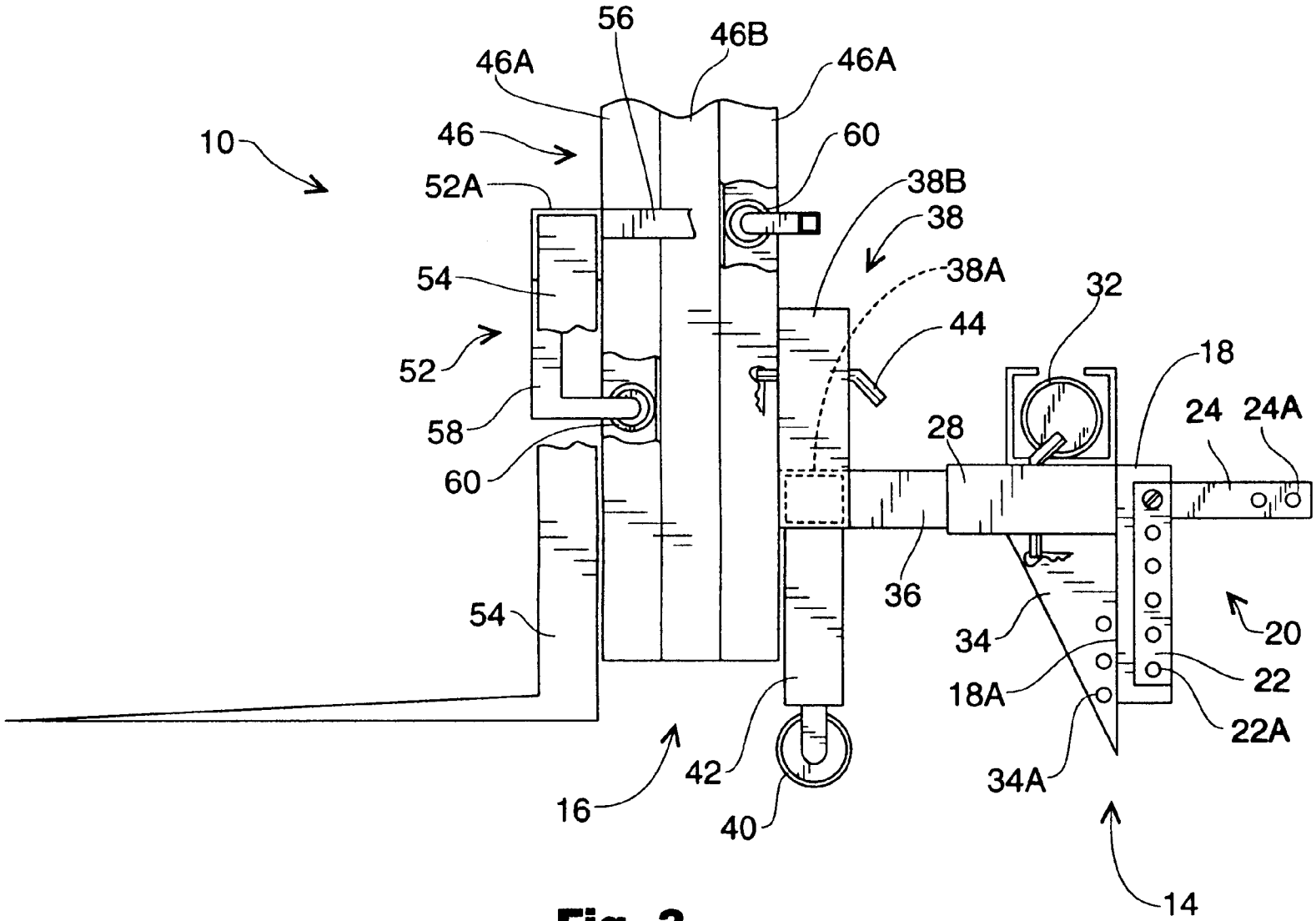
FIG. 3 is a partial side elevational view of the device of the present invention.

FIG. 1 is a perspective view of a device 10 of the present invention mounted to a front of a vehicle 12. The device 10 includes a winch and rail assembly support structure 14, a rail assembly 16, and a fork assembly 52. FIG. 2 is an exploded perspective view of the winch and rail assembly support structure 14 and the vehicle 12, shown apart from the rail assembly 16. FIG. 3 is a partial side elevational view of the device 10.

Referring to FIGS. 1–3, the winch and rail assembly support structure 14 is adapted to mount to the front of the vehicle 12 in a vertically adjustable manner. The winch and rail assembly support structure 14 comprises a support channel 18 adapted to extend horizontally along the front of the vehicle 12. The support channel 18 has a broad central web 18A. Two mounting structures 20 are connected to a vehicle facing side of the central web 18A at opposing ends thereof. Each mounting structure 20 comprises a first plate 22 extending transversely across the central web 18A and having a plurality of mounting holes 22A therein, and a second plate 24 mounted to and extending outwardly from the first plate 22, and having a plurality of mounting holes 24A therein.

A pair of third plates 26 are welded to a frame (not shown) of the vehicle 12 in a conventional manner. The third plates 26 have mounting holes 26A therein, for connecting to the mounting holes 24A of the second plates 24, for connecting the winch and rail assembly support structure 14 to the vehicle 12.

The winch and rail assembly support structure 14 is vertically adjustable on the vehicle 12 by mounting the second plates 24 to any selected mounting hole 22A on the first plates 22.

Two rail assembly support sleeves 28 extend outwardly from an outward facing side of the central web 18A at opposing ends thereof. A winch support plate 30 extends between the rail assembly support sleeves 28 and supports a winch 32 thereon. Plate end supports 34 are connected to the rail assembly support sleeves 28 and the central web 18A at each end of the winch support plate 30, for supporting the winch support plate 30. The plate end supports 34 each include mounting holes 34A therein for attaching other accessories thereto, such as a snow plow (not shown) when the rail assembly 16 is not connected to the winch and rail assembly support structure 14.

Figure 4:
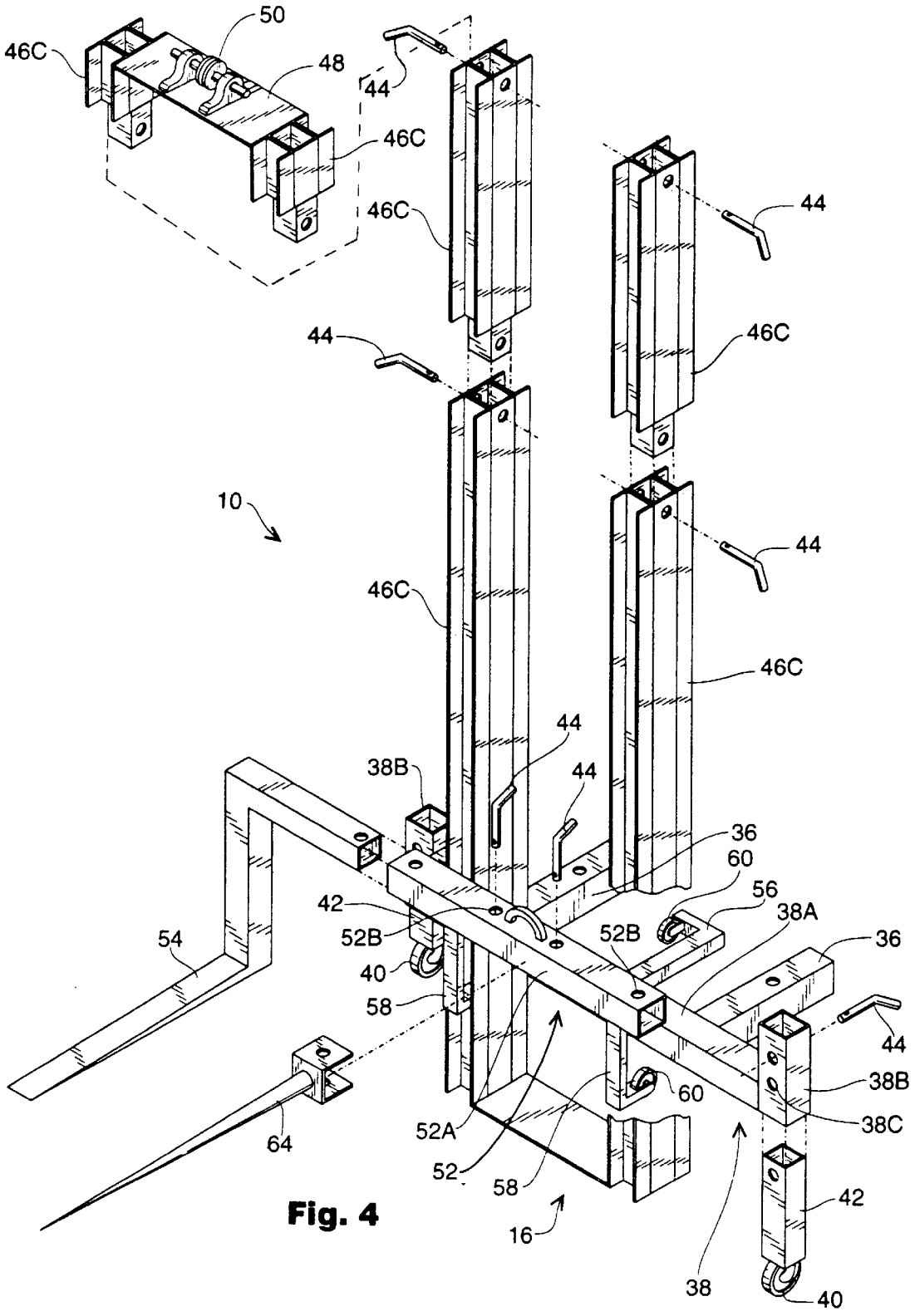
FIG. 4 is an exploded perspective view of the device of the present invention.

FIG. 4 is an exploded perspective view of the device 10 of the present invention. Referring to FIGS. 1–4 a rail assembly support structure 38 includes a tubular horizontal member 38A and an upwardly extended leg sleeve 38B at each end of the horizontal member 38A. A pair of wheels 40 are connected to legs 42 which slide into the leg sleeves 38B. A plurality of mounting holes 38C are provided in the leg sleeves 38B, so that the wheels 40 are vertically adjustable in relation to the rail assembly support structure 38.

Conventional rod and cotter pin assemblies 44 are used in a conventional manner to connect the legs 42 to the leg sleeves 38B, and throughout the device 10 where shown in the illustrations for removable connection between the various components of the invention.

The rail assembly support structure 38 further includes two tubular extensions 36 configured to slide into the rail assembly support sleeves 28 to removably connect to the winch and rail assembly support structure 14.

The rail assembly support structure 38 is welded to a pair of vertically oriented, opposing elongated rails 46, spaced a predetermined distance apart from each other. Each elongated rail 46 comprises two channels 46A on opposing sides of a central tubular member 46B. A pulley support plate 48 extends between top ends of the rails 46, and supports a pulley 50.

Referring primarily to FIG. 4, each of the rails 46 comprises a plurality of segments 46C which are connectable end to end to vary the height of the rails 46.

Referring again to FIGS. 1–4, a fork assembly 52 comprises a tubular, elongated fork support arm 52A configured to span between the rails 46. A pair of forks 54 are configured to connect to the fork support arm 52A. The distance between the forks 54 on the support arm 52A is adjustable by selecting the mounting hole 52B into which the rod and cotter pin assembly 44 is inserted.

A roller wheel horizontal arm 56 extends outward from each end of the fork support arm 52A. A roller wheel vertical arm 58 extends downward from each end of the fork support arm 52A. The roller wheel horizontal and vertical arms 56, 58 each have a roller wheel 60 mounted to a distal end thereof.

The roller wheels 60 mounted on the roller wheel horizontal arms 56 ride within the channels 46A which are across the tubular member 46B from the fork support arm 52A. The roller wheels 60 mounted on the roller wheel vertical arms 58 ride within the channels 46A which are on the same side of the tubular member 46B as the fork support arm 52A.

An elongated flexible member 62 is configured to extend from the winch 32, over the pulley 50, and from the pulley 50 to the fork support arm 52A. The fork support arm 52A is configured to connect to the flexible member 62. When the winch 32 is operated in a first direction, the flexible member 62 pulls the fork assembly 52 upward along the rails 46, and when the winch 32 is operated in a second direction, the fork assembly 52 is lowered along the rails 46.

A spike 64 is configured to removably attach to the fork support arm 52A, for stabilizing hay bales (not shown) being carried by the forks 54.

The foregoing description is included to describe embodiments of the present invention which include the preferred embodiment, and is not meant to limit the scope of the invention. From the foregoing description, many variations will be apparent to those skilled in the art that would be encompassed by the spirit and scope of the invention. Accordingly, the scope of the invention is to be limited only by the following claims and their legal equivalents.

The invention claimed is:

1. A device for attaching to a vehicle to form a fork lift, the device comprising:

a. a winch and rail assembly support structure comprising:
  i. a support channel;
  ii. a mounting structure connected to the support channel and adapted to mount to a front of a vehicle such that the support channel is vertically adjustable on the vehicle;
  iii. a pair of elongated rail assembly support members extending outwardly from the support channel;
  iv. a winch support plate extending between the rail assembly support members;

b. a winch supported by the winch support plate;

c. a rail assembly support structure comprising:
  i. an elongated member;
  ii. a pair of tubular extensions connected to the elongated member and configured to slidingly mate with the rail assembly support members to connect the elongated member to the winch and rail assembly support structure;
  iii. at least one wheel support assembly attached to the elongated member;
  iv. a wheel configured to attach to each of the at least one wheel support assembly, each wheel adapted to rest on grade when the elongated member is connected to the winch and rail assembly support structure and the winch and rail assembly support structure is connected to the vehicle;

d. a rail assembly comprising:
  i. two opposing elongated rails connected to the elongated member;
  ii. each elongated rail comprising two opposing tracks;
  iii. a pulley supported at a distal end of the rails;

e. a fork assembly comprising:
  i. an elongated fork support arm configured to span between the rails;
  ii. a pair of forks configured to connect to the fork support arm; and
  iii. a plurality of roller wheels connected to the elongated fork support arm, a first pair of the roller wheels configured to ride within the two opposing tracks of a first one of the rails, and a second pair of the roller wheels configured to ride within the two opposing tracks of a second one of the rails;

e. a flexible elongated member configured to extend from the winch, over the pulley, and from the pulley to the fork support arm, the fork support arm configured to connect to the flexible elongated member, wherein when the winch is operated in a first direction, the flexible elongated member pulls the fork assembly upward along the rails, and when the winch is operated in a second direction, the fork assembly is lowered along the rails.

2. The device of claim 1, wherein a distance between the forks on the fork support arm is adjustable.

3. The device of claim 1, wherein the location of the wheel relative to the wheel support assembly is adjustable.

4. The device of claim 1 further comprising a spike configured to removably attach to the fork support arm, for stabilizing hay bales being carried by the forks.

5. The device of claim 1, wherein each of the rails is length adjustable.

6. The device of claim 1, wherein each of the rails comprises a plurality of segments which are connectable end to end to vary a length of the rail.

7. The device of claim 1, wherein each of the rail assembly support members has a plate end support connected thereto and to the support channel for supporting the winch support plate.

8. The device of claim 7, wherein the plate end supports each include a plurality of mounting holes adapted for attaching accessories thereto when the rail assembly is not connected to the winch and rail assembly support structure.

9. A device for attaching to a vehicle to form a fork lift, the device comprising:

a. a winch and rail assembly support structure adapted to mount to a front of a vehicle;

b. a winch supported by the winch and rail assembly support structure;

c. a rail assembly configured to removably connect to the winch and rail assembly support structure, the rail assembly comprising:

i. two opposing elongated rails;

ii. each of the rails comprising three segments which are connectable end to end, and the length of the rail is reducible by omitting one of the segments;

iii. each elongated rail comprising two opposing tracks; and iv. a pulley supported at a distal end of the rails;

d. a fork assembly comprising:

i. an elongated fork support arm configured to span between the rails;

ii. a pair of forks configured to connect to the fork support arm; and iii. a plurality of roller wheels connected to the elongated fork support arm, a first pair of the roller wheels configured to ride within the two opposing tracks of a first one of the rails, and a second pair of the roller wheels configured to ride within the two opposing tracks of a second one of the rails;

e. a flexible elongated member configured to extend from the winch, over the pulley, and from the pulley to the fork support arm, the fork support arm configured to connect to the flexible elongated member, wherein when the winch is operated in a first direction, the flexible elongated member pulls the fork assembly upward along the rails, and when the winch is operated in a second direction, the fork assembly is lowered along the rails.

10. The device of claim 9, wherein a distance between the forks on the fork support arm is adjustable.

11. The device of claim 9, wherein the rail assembly further comprises at least one wheel adapted to rest on grade when the rail assembly is attached to the vehicle.

12. The device of claim 9, wherein the at least one wheel is vertically adjustable when the fork assembly is attached to the vehicle.

13. The device of claim 9, wherein the winch and rail assembly support structure is adapted to be vertically adjustable on the vehicle.

14. The device of claim 9, further comprising a spike configured to removably attach to the fork support arm, for stabilizing hay bales being carried by the forks.

* * * * *